United States Patent [19]

Grove et al.

[11] 4,194,723

[45] Mar. 25, 1980

[54] SCISSORS LINKAGE WORKMAN'S PLATFORM

[75] Inventors: John L. Grove, Greencastle; Gregg A. Wagner, Chambersburg, both of Pa.

[73] Assignee: JLG Industries, Inc., McConnellsburg, Pa.

[21] Appl. No.: 896,619

[22] Filed: Apr. 14, 1978

[51] Int. Cl.[2] ..... B66F 3/22

[52] U.S. Cl. ..... 254/9 C9; 254/122

[58] Field of Search ..... 182/157, 191, 158, 12 A; 254/9 R, 9 BC, 122; 74/521

[56] References Cited

U.S. PATENT DOCUMENTS

| | | | |
|---|---|---|---|
| 136,883 | 3/1873 | Von Ehren | 182/141 |
| 226,101 | 3/1880 | Pfavtz | 182/141 |
| 226,981 | 4/1880 | Conover | 182/141 |
| 512,052 | 1/1894 | McHenry | 182/141 |
| 1,859,830 | 5/1932 | Kümmel | 254/122 |
| 2,625,443 | 1/1953 | Sensenbaugh | 254/122 |
| 3,112,676 | 12/1963 | Boulsover | 254/122 |
| 3,350,065 | 10/1967 | Mankey | 254/122 |
| 3,412,873 | 11/1968 | Barker | 214/1 |
| 3,472,488 | 10/1969 | Naughton | 254/122 |
| 3,823,915 | 7/1974 | Koehler | 254/122 |
| 3,892,142 | 7/1975 | Karls | 74/521 |
| 3,961,681 | 6/1976 | Fisher | 182/14 X |
| 4,113,065 | 9/1978 | Sikli | 182/141 X |

FOREIGN PATENT DOCUMENTS

| | | | |
|---|---|---|---|
| 927600 | 5/1963 | United Kingdom | 254/122 |

*Primary Examiner*—RobertC. Watson
*Attorney, Agent, or Firm*—Irvin A. Lavine

[57] ABSTRACT

A workman's platform comprising a wheeled base, scissors linkage having plural sets of lever arms and a deck vertically movable by the linkage. All ends of the linkage arms are longitudinally movable on the base and deck. An upper centering link is pivoted at one end to the mid-point of the deck and at the other end to the mid-point of an upper lever arm. A lower centering link is similarly connected to the deck and to a lower lever arm. The adjacent ends of the lever arms are off-set and pin-connected, the lever arms being in spaced,parallel relation when the linkage is retracted. A single vertically movable actuating element is connected to the pivot pin of the lower set of lever arms.

9 Claims, 4 Drawing Figures

SCISSORS LINKAGE WORKMAN'S PLATFORM

BACKGROUND OF THE INVENTION

The present invention relates to apparatus for elevating personnel and/or loads, utilizing scissors-type linkage.

Personnel elevating apparatus utilizing scissors linkage has long been known. Such apparatus was early developed for use as fire escapes, examples being Von Ehren U.S. Pat. No. 136,883 and Pfautz U.S. Pat. No. 226,101. Currently, and for a number of years, lift apparatus utilizing scissors linkage has found great utility in connection with the elevation of workmen to a position so that they could carry out some desired task.

The workman's platform apparatus which have heretofore been produced have utilized laterally off-set, side-by-side scissor linkages, each scissor linkage having one or more sets of lever arms. The lower ends of the lower lever arms were connected to a base, and the upper ends of the upper lever arms were connected to the elevatable deck; at least one of these arms was pivotally connected to the base, or deck, as the case may be, and usually one arm was pivotally connected to the deck and one arm pivotally connected to the base. The other arm ends were confined to move in a rectilinear manner, that is, with straight line motion, relative to the deck or base with which it was associated, or on which it was mounted. The scissors linkage was actuated by an electric motor or hydraulic cylinder connected to the base and to the linearly movable lever arm end. In some embodiments, in the fully retracted condition, the lever arms were inclined, thereby limiting the minimum height of the workman's platform apparatus. In other embodiments, the lever arms assumed a horizontal position, when the scissor linkage was fully retracted, but such apparatus required not only the noted actuating motor, but one or more additional motors which were utilized to initiate movement of the scissor linkage so that the lever arms were rotated from the horizontal position to an inclined position, following which the main actuating motor was able to move the end of the lever arm to which it was attached, and thereby elevated the deck.

These scissor linkage workman's platform have been found to be objectionable from the point of view of safety, because upon actuation of the scissor linkage, the fingers or limbs of personnel could be caught between the lever arms, as they closed together. This problem has been overcome in the prior art by the provision of lever arms having ends which are off-set, thereby providing a space between serially connected lever arms, to avoid injury to personnel. This is known as the avoidance of "pinch points".

Mankey U.S. Pat. No. 3,350,065 illustrates scissor linkage apparatus which, in the retracted position, has the lever arms substantially parallel and horizontal. A linear actuator extends between pivot pins connecting the upper ends of lower lever arms and the lower ends of upper lever arms, in a horizontal plane. This apparatus has a very low collapsed or retracted height, but in order to extend or elevate the scissor linkage, there are provided cam constructions on the ends of the serially connected lever arms, thereby adding considerably to the expense and complexity of the apparatus, in addition to requiring the elevation of the entire linear actuator. This patent also shows a construction in which the linear actuator is connected to the lower ends of the single set of lever arms, but in this case, the collapsed or retracted height is substantially higher, and the lever arms never are positioned horizontally, but are always inclined.

The above described, currently used scissors linkage workman's platform apparatus necessarily has a non-uniform load applied to the linkage when the deck is elevated, because the deck becomes, in part, cantilevered relative to the supporting linkage. This construction has been utilized, despite disclosures such as found in Boulsover U.S. Pat. No. 3,112,676 and Koehler U.S. Pat. No. 3,823,915; in both of these disclosures, the ends of all of the lever arms which are associated with or connected to the base and the deck are linearly movable, and in addition, there are provided in these disclosures centering links or stays which are pivotally connected to either or both of the base and deck, on the one hand, and to an adjacent lever arm, on the other hand. Thus, these patents disclose constructions which provide uniformity of load distribution from the deck into the linkage, and also enable the deck to be maintained centered relative to the linkage and the linkage maintained centered relative to the base, during extension and retraction of the scissors linkage. However, in Boulsover, the collapsed height of the apparatus is higher than desirable, the arms being at all times inclined, and in Koehler the arms also are inclined in all positions of the apparatus.

SUMMARY OF THE INVENTION

The present invention provides a workman's platform with scissor linkage for elevation. The lever arms are in parallel, spaced relationship in the retracted position of the apparatus, to provide low retracted or collapsed height, and to provide, also, safety and the avoidance of "pinch points". The deck is uniformly supported by the linkage, and is not cantilevered, the upper ends of the lever arms which are mounted on or associated with the deck both being linearly movable. Further, the ends of the lower lever arms which are mounted on or are associated with the base are similarly linearly movable. Upper and lower centering links are provided, the upper centering link being pivotally connected to the deck, and to the upper lever arms. The lower centering link is similarly connected to the lower lever arm and to the base. The lower centering link has a U-shaped element, into which extends the piston rod of a hydraulic lift motor, the hydraulic lift motor being positioned on a a vertical axis and the piston moving vertically. The piston, which is located in the arms of the U-shaped element of the centering link when the apparatus is in the retracted or collapsed condition, is the sole actuating element, and moves only in the vertical direction. The ends of serially-connected lever arms are provided with ears, so that the connecting pin between serially connected lever arms is off-set from the axes of both of the lever arms.

Among the objects of the present invention, therefore, are the provision of a scissors linkage workman's platform which is safe, avoiding injury to personnel by the avoidance of "pinch points", which is economical, requiring but a single motor for actuation, which provides for even loading of the linkage from the deck, by providing equal support for the deck by the linkage in all positions, which provides for even loading of the base by equalized movement of the lower ends of the linkage arms, and which has a low retracted height, characterized by horizontal positions of the lever arms.

DESCRIPTION OF THE PREFERRED EMBODIMENT

Figure 1:
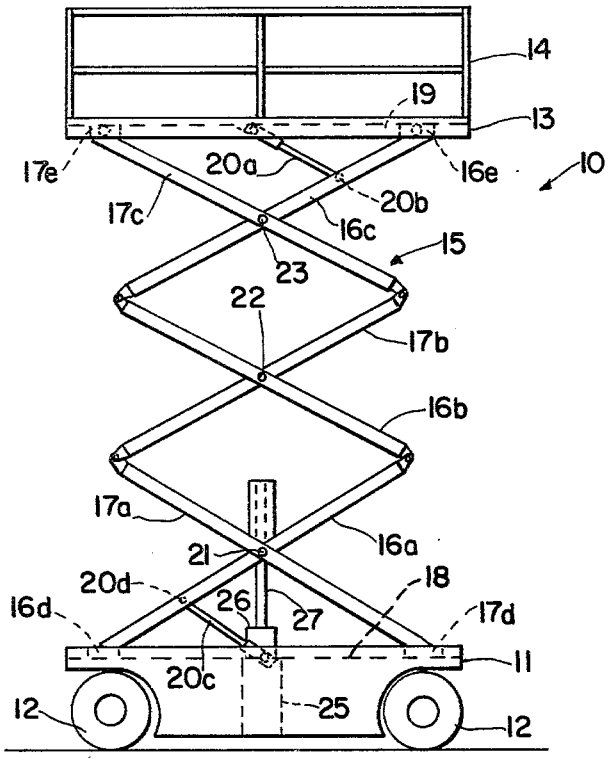
FIG. 1 is an elevational view of a workman's platform in accordance with the present invention, in extended position.

Referring now to the drawings, wherein like or corresponding parts are designated by like or corresponding parts are designated by like or corresponding reference numerals throughout the several views, there is shown in FIG. 1 a workman's platform generally designated 10, and comprising a base 11 supported on wheels 12. The base 11 may support beneath it, and generally between the wheels 12, of which there are four, a motor for driving a pump (not shown) and for driving two of the four wheels 12. Such accessories are conventional and are not shown herein.

An elevatable deck 13 is provided, having guard railing 14 extending upwardly from it, so as to provide for the safety of workmen carried on deck 13. Deck 13 is raised and lowered by scissor linkage 15, there being a first set of scissor linkage as shown in FIG. 1, and a second set parallel and laterally off-set from it, to be herein below discussed.

The scissor linkage 15 includes, in its preferred form, lower inside lever arm 16*a*, middle inside lever arm 16*b* and upper inside lever arm 16*c*; linkage 15 also includes lower outer lever arm 17*a*, middleouter lever arm 17*b* and upper outer lever arm 17*c*. As is conventional, the lever arms are of equal length, with lever arms 16*a* and 17*a* which are a first set being pivotally connected at their mid-points, as are lever arms 16*b* and 17*b* which are a second set, as well as lever arms 16*c* and 17*c*, which are a third set. In addition, the upper end of lever arm 16*a* is pivotally connected to the lower end of lever arm 16*b*, the upper end of which is connected to the lower end of arm 16*c*. Lever arms 17*a*, 17*b* and 17*c* are similarly pivotally connected. The scissor linkage 15 has, therefore, been illustrated as having three inner and three outer lever arms, although it will be appreciated that a fewer or greater number of sets of lever arms may be provided.

The lower ends of lever arms 16*a* and 17*a* are provided with slide elements 16*d* and 17*d*, respectively, to which they are pivotally connected. The base 11 includes a suitable slide guide structure 18, to restrict the movement of slide elements 16*d* and 17*d* to linear movement. In similar manner, the upper ends of the lever arms 16*c* and 17*c* are pivotally connected to slide elements 16*e* and 17*e*, respectively, which are constrained to linear movement by slide guide 19 carried by the deck 13.

The lever arms 16*a* and 17*a* are connected by a pivot pin 21, the lever arms 16*b* and 17*b* are connected by a pivot pin 22 and the lever arms 16*c* and 17*c* are connected by a pivot pin 23. The deck 13 is caused to be raised by extending the pistons 26 and 27 of a hydraulic motor 25, carried by the base 11, in the center of the base 11, both longitudinally and laterally, the hydraulic motor 25 having the axis thereof vertical in the normal position of the workman's platform 10, when the base 11 is horizontal.

An upper centering link 20*a* has its upper end pivotally connected to the mid-point, in the longitudinal direction, of the deck 13, and has its lower end pivotally connected to the lever arm 16*c*. The axis of the pivotal connection between centering link 20*a* and lever arm 16*c* is designated 20*b*, and is located mid-way between the axis of pivot pin 23 and the axis of the pivotal connection between lever arm 16*c* and the slide element 16*e*. A lower centering link 20*c* has its lower end pivotally connected at the axis 20*d* to the lever arm 16*a*, mid-way between the axis of pivot pin 21 and the pivotal connection of the lower end of lever arm 16*a* and the slide element 16*d*. The centering links 20*a* and 20*c* are of identical construction, and restrict the movement of the linkage 15, when it is extended and retracted, so that the lower ends of the lever arms 16*a* and 17*a*, on the one hand, and the upper ends of the lever arms 16*c* and 17*c*, on the other hand, move equally and oppositely to each other; at any position of the scissor linkage 15, the noted ends of these four lever arms will be equally distant from the center of the base 11 and deck 13, respectively, where there are located the lower pivotal axis of lower centering link 20*c* and the upper pivotal axis of the upper centering link 20*a*. By this construction, the deck 13 always has uniformity of support on the scissor linkage. That is, the load of the deck 13 is distributed uniformly on the scissor linkage which supports it.

Figure 2:
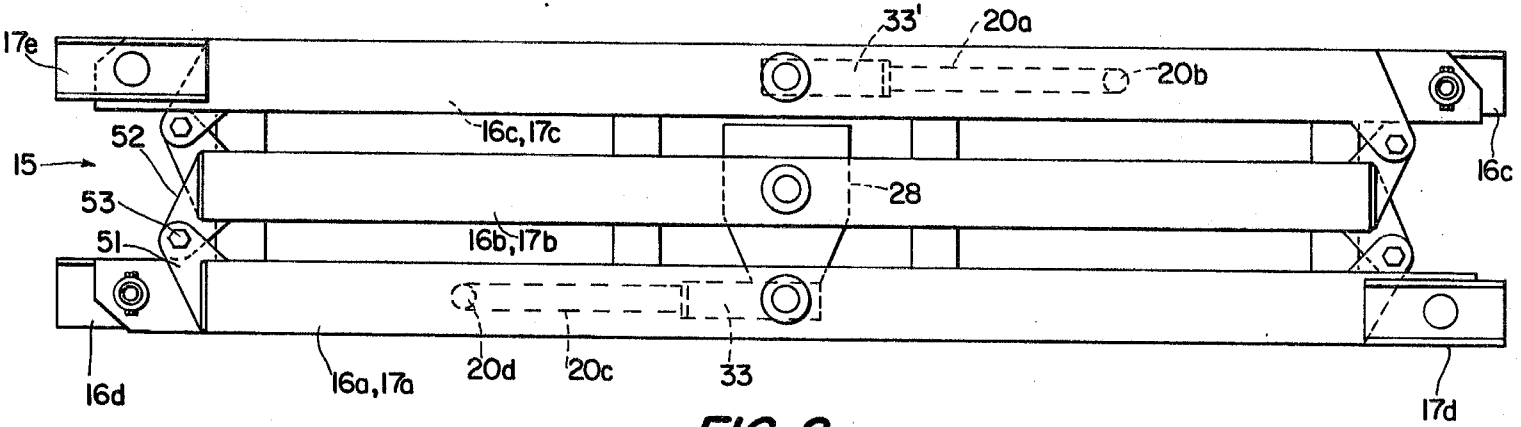
FIG. 2 is an elevational view, with parts broken away, of a workman's platform of FIG. 1, in retracted position.

Referring now to FIG. 2, the scissor linkage 15 is shown in the retracted or collapsed condition, the base 11 and the deck 13, being omitted for clarity. The lower centering link 20*c* is shown lying horizontally, as are the lower lever arms 16*a* and 17*a*. Above and spaced from them are the middle level arms 16*b* and 17*b*, and above and spaced from them are the upper lever arms 16*c* and 17*c*. The upper centering link 20*a* is also shown, connected at its right end to the upper lever arms 16*c* at 20*b*. The centering links are shown to be horizontal in FIG. 2, and are therefore parallel; these centering links are parallel in any position of the scissor linkage, including that shown in FIG. 1. Also shown in FIG. 2 are the slide elements 16*d*, 17*d*, and 16*e*, 17*e*.

As shown in FIG. 2, the lever arm 16*a* is provided with an upstanding ear 51, and the lever arm 16*b* has a depending ear 52, so that the pivot pin 53 which connects the ears 51 and 52 has its axis above the upper surface of lever arm 16*a* and below the lower surface of lever arm 16*b*. The axis of the lever arms are spaced from the pin connection, such as pivot pin 53, between adjacent lever arms, such as lever arms 16*a* and 16*b*. Similar construction is provided in connection with all of the arms, so that in the collapsed condition, the arms are vertically spaced and are substantially horizontal. As a result, there is no danger that the limbs of personnel will be caught between the lever arms of the scissor linkage when it is extended and retracted, thereby preventing injury to personnel.

Figure 3:
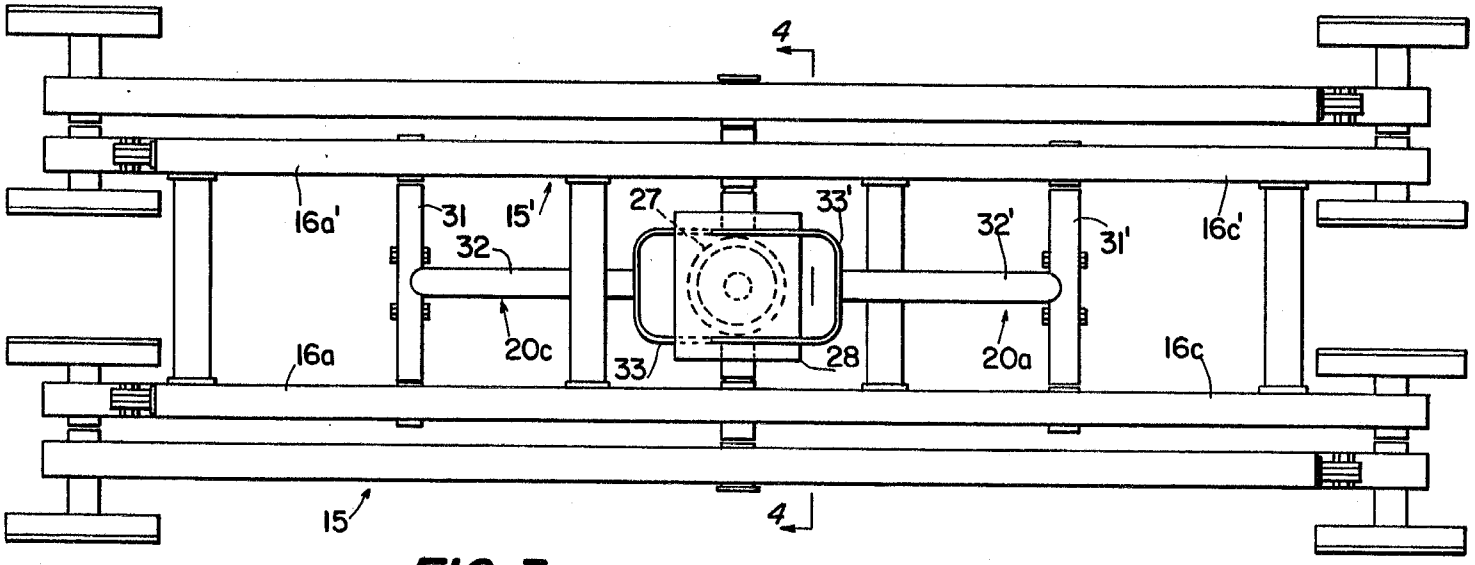
FIG. 3 is a plan view, with parts removed, showing scissors linkage and centering links forming a part of the platform of the present invention.

Referring now to FIG. 3, there is shown the scissor linkage 15 and 15', which are identical. The scissor linkages 15 and 15' are in opposed, parallel relationship, in conventional manner, and there are shown the lower inner lever arms 16*a* and 16*a*'. The lower centering link 20c comprises a first bar 31 pivotally connected to the lever arms 16a and 16a', and extending perpendicularly between them. Centering link 20c also includes a second bar 32 having one end secured to the bar 31, and being perpendicular to it, and having a U-shaped element 32 connected to its opposite end, the second bar 32 being joined to the mid-point of the U-shaped element 33. The ends of the U-shaped element 33 of lower centering link 20c is pivotally connected to a suitable portion of the base 11, at its longitudinal mid-point. The driven piston rod 27 is shown extending into the space between the arms of the U-shaped element 33 of lower centering link 20c. The upper centering link 20a is identical in construction to the lower centering link 20c, having the bar 31' thereof connected to the upper lever arms 16c and 16c'; the U-shaped element 33' connected to the second bar 32', is pivotally connected, as above noted, to the mid-point of the deck 13.

Figure 4:
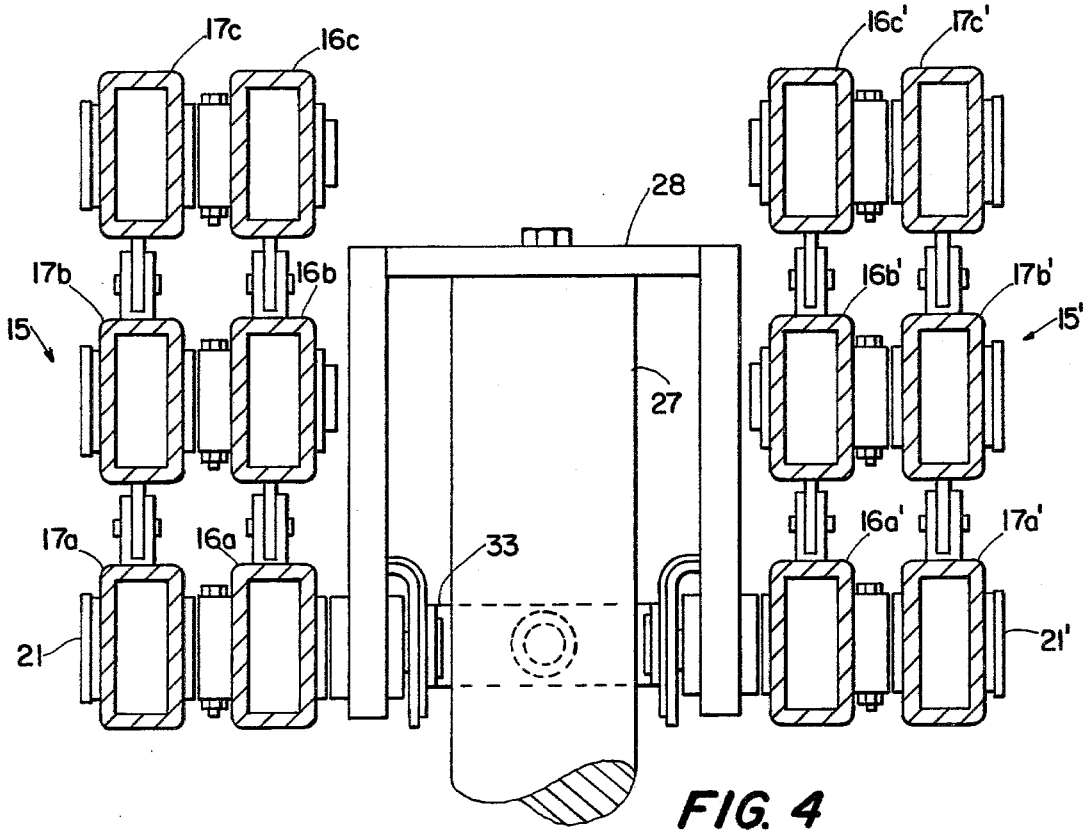
FIG. 4 is a cross-sectional view taken on the line 4—4 of FIG. 3.

In FIG. 4, there is shown the base 11, with the six arms of the linkage 15 and the six arms of the linkage 15'. The piston 27 is shown, with a connector 28 which extends from the top of piston 27 downwardly, and being connected to the pivot pin 21, which is the pivot pin connecting the lever arms of the lowest set of lever arms of scissor linkage 15; the connector 28 also extends to and is connected to the pivot pin 21', of the scissor linkage 15'.

There has been provided a scissors linkage workman's platform which is of safe construction, with the avoidance of "pinch points" which would injure personnel, the workman's platform being economical, having but a single motor for actuation of the scissors linkage. Further, the load of the deck is evenly distributed into the linkage arms, in any position of the deck, and the load of the deck and linkage arms is evenly distributed to the base, in any position of the deck. This is achieved by the provision of linear movement for the end of all arms which engage the base and deck, there being provided centering links to maintain the linkage centered relative to both the base and deck. A low retracted height is provided by the construction wherein the lever arms are horizontal in the retracted condition, the lever arms having simple upstanding ear and pin connections, which are readily constructed, and reliable in operation.

It will be obvious to those skilled in the art that various changes may be made without departing from the spirit of the invention, and therefore the invention is not limited to what is shown in the drawings and described in the specification but only as indicated in the appended claims.

We claim:

1. A workman's platform comprising:

a wheeled base for movement over a surface, a deck above the base, scissors linkages for elevating the deck each comprising plural sets of pin-connected lever arms, the ends of the lever arms connected to another lever arm being off-set and pin-connected, so that the axis of each lever arm is spaced from the pin-connection between adjacent lever arms, said arms in the retracted position of each said scissors linkage being horizontal, parallel and spaced apart, means for mounting the upper end of both of the upper lever arms of each set on said deck for movement towards and away from each other and for permitting said upper lever arms to be in horizontal position when said upper ends of said upper lever arms are most remote from each other in the retracted position of said scissors linkages, centering link means pivotally connected to said deck and to an upper lever arm of each set, and being horizontal in the retracted position of said scissors linkages, means for mounting the lower ends of both of the lower lever arms of each set on said base for movement towards and away from each other and for permitting said lower lever arms to be in horizontal position when said lower ends of said lower lever arms are most remote from each other in the retracted position of said scissors linkages, centering link means pivotally connected to said base and to a lower lever arm of each set and being horizontal in the retracted position of said scissors linkages, actuating means for said scissors linkages mounted on the base having a linearly vertically movable driven element, and means connecting said driven element to the pivot pins connecting the lever arms of the lowest sets of lever arms.

2. A workman's platform as set forth in claim 1, each said centering link connected to the mid-point of the lever arm between its end and the pivotal connection thereof with another lever arm and to the mid-point of the base or deck, respectively.

3. A workman's platform as set forth in claim 1, said upper and lowering centering links being parallel to each other.

4. A workman's platform as set forth in claim 1, wherein said actuating means comprises a hydraulic cylinder having its axis vertical.

5. A workman's platform as set forth in claim 1, said actuating means being the sole actuating means for said scissors linkage.

6. A workman's platform as set forth in claim 5, said connecting means extending downwardly from the top of said driven element to said last mentioned pivot pin.

7. A workman's platform as set forth in claim 1, wherein said means for mounting the upper end of the upper lever arms and the means for mounting the lower end of the lower lever arms comprises a slide element pivotally connected to each said end and slide guide structure means carried by said deck and said base for restricting movement of said slide elements to linear movement.

8. A workman's platform comprising:

a base, a deck above the base, laterally spaced scissors linkages for elevating the deck each comprising plural sets of pin-connected lever arms, the ends of the lever arms connected to another lever arm being off-set and pin-connected, so that the axis of each lever arm is spaced from the pin-connected between adjacent lever arms, said arms in the retracted position of each said scissors linkage being horizontal, parallel and spaced apart, means for mounting the upper end of both of the upper lever arms of each set on said deck for movement towards and away from each other, first centering link means pivotally connected to said deck and to an upper lever arm of each set, means for mounting the lower ends of both of the lower lever arms of each set on said base for movement towards and away from each other, actuating means for said scissors linkages mounted on the base having a vertically movable driven element, means connecting said driven element to the pivot pin-connecting the lever arms of the lowest set of lever arms, and second centering link means comprising a first bar extending between and connected to opposed lever arms of the lower sets of said scissor linkages, a second bar having one end secured to said first bar and being perpendicular thereto, and a U-shaped element having the mid-point thereof secured to the other end of the second bar and havng its ends pivotally secured to the base, said driven element of said actuating means extending into the space between the arms of said U-shaped element.

9. A workman's platform as set forth in claim 8, said first centering link comprising a first bar extending between and connected to opposed lever arms of the upper sets of said scissor linkages, a second bar having one end secured to said first bar and being perpendicular thereto, and a U-shaped element having the mid-point thereof secured to the other end of the second bar and having its ends pivotally secured to the deck.

* * * * *